United States Patent [19]

Santo

[11] Patent Number: 4,663,790

[45] Date of Patent: May 12, 1987

[54] MARGINAL PERIMETER SUPPORT CONTAINMENT CHAMBER FOR A FLOATATION SLEEP SYSTEM

[76] Inventor: Philip J. Santo, 12 Mountain Rd., Rochester, N.Y. 14625

[21] Appl. No.: 769,015

[22] Filed: Aug. 26, 1985

[51] Int. Cl.[4] ..... A47C 27/10

[52] U.S. Cl. ..... 5/452; 5/451; 156/227

[58] Field of Search ..... 5/452, 451, 449, 450, 5/457, 458, 422, 441

[56] References Cited

U.S. PATENT DOCUMENTS

| | | | |
|---|---|---|---|
| 3,735,432 | 5/1973 | Kreten et al. | 5/451 |
| 4,079,473 | 3/1978 | Phillips | 5/452 |
| 4,100,635 | 7/1978 | Mitchell et al. | 5/452 |
| 4,245,364 | 1/1981 | Calleance | 5/452 |
| 4,534,078 | 8/1985 | Viesturs et al. | 5/452 |

*Primary Examiner*—Alexander Grosz

*Attorney, Agent, or Firm*—Lawrence P. Kessler

[57] ABSTRACT

A floatation sleep system including an improved marginal perimeter support containment chamber of relatively simple construction assembled by a relatively inexpensive manufacturing process. The improved marginal perimeter support containment chamber comprises a flexible, dimensionally stable, sheet having a surface area of substantially rectangular shape with portions extending outwardly from the marginal edges of such surface area. The portions are folded back and joined to the surface area within the marginal edges thereof to form a cavity adapted to receive a bladder and a support mechanism for substantially the full perimeter of a bladder received within such cavity. The dimensions of the area bounded by the joining of such portions to the surface area are less than the corresponding surface area of the received bladder, whereby the received bladder overlies a segment of such portions and the weight of the bladder acts on such segments to hold the support mechanism in effective perimeter support relation with such bladder.

2 Claims, 5 Drawing Figures

MARGINAL PERIMETER SUPPORT CONTAINMENT CHAMBER FOR A FLOATATION SLEEP SYSTEM

BACKGROUND OF THE INVENTION

This invention relates generally to floatation sleep systems, and more particularly to a floatation sleep system including an improved marginal perimeter support containment chamber.

In my U.S. Pat. No. 4,513,463, issued Apr. 30, 1985, I have disclosed an advancement in floatation sleep systems of the universal type where the bladder and the perimeter support are seperable, and wherein the bladder may be readily replaced without having to replace the entire sleep system. Such advanced flotation sleep system includes an accessible perimeter containment chamber containing a marginal perimeter support. A flexible, dimensionally stable sheet is connected to the upper portion of the perimeter chamber. The sheet forms a support chamber for a water-containing bladder, such chamber being suspended from the perimeter containment chamber, wherby when a bladder is inserted in its support chamber, the weight of the bladder exerts a force through such chamber on the perimeter containment chamber to hold the marginal perimeter support in effective support relation to such bladder. Specifically, the sheet forming the support chamber is of an overall dimension greater than the distance between opposed portions of the perimeter containment chamber and less than the distance between such opposed portions plus twice the vertical height of such perimeter containment chamber. While this patented advanced floatation sleep system provides the intended universality and adequately functions to retain the perimeter support in effective support relation with its contained bladder, it is of a relatively complicated construction assembled by a relatively expensive manufacturing process.

SUMMARY OF THE INVENTION

This invention is directed to a floatation sleep system including an improved marginal perimeter support containment chamber of relatively simple construction and assembled by a relatively less expensive manufacturing process than with the advanced universal flotation sleep system of my aforementioned U.S. Pat. No. 4,513,463. The improved marginal perimeter support containment chamber comprises a flexible, dimensionally stable, sheet having a surface area of substantially rectangular shape with portions extending outwardly from the marginal edges of such surface area. The portions are folded back and joined to the surface area within the marginal edges thereof to form a cavity adapted to receive a bladder and a support mechanism for the perimeter of a bladder received within such cavity. The dimensions of the area bounded by the joining of such portions to the surface area are less than the corresponding surface area of the received bladder, whereby the received bladder overlies a segment of such portions and the weight of the bladder acts on such segments to hold the support mechanism in effective perimeter support relation with such bladder.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
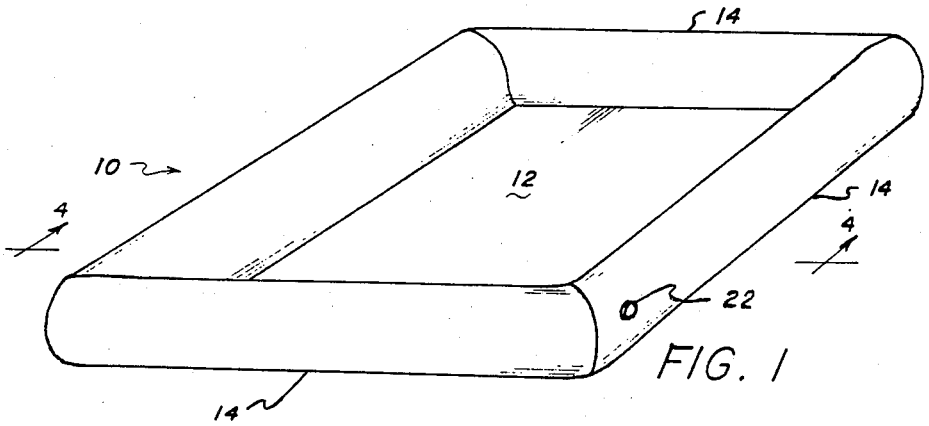
FIG. 1 is a view, in perspectve, of an improved marginal perimeter support containment chamber according to this invention.
Figure 4:
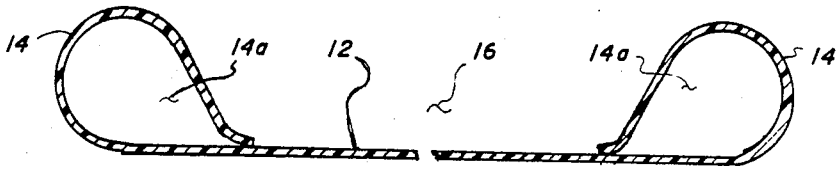
FIG. 4 is an end elevational view of the containment chamber, in cross-section taken generally along lines 4—4 of FIG. 1.
Figure 2:
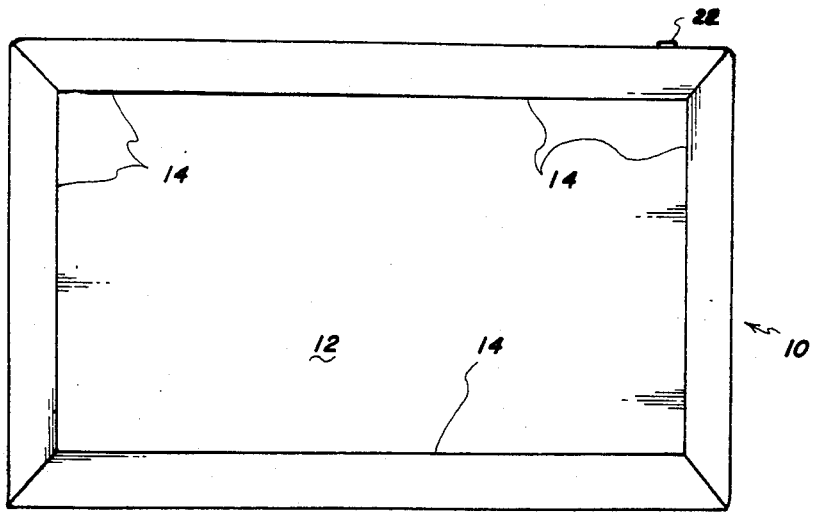
FIG. 2 is a top plan view of the containment chamber of FIG. 1.

Referring now to the accompanying drawings, FIGS. 1, 2 and 4 show an improved marginal perimeter support containment chamber, according to this invention for a floatation sleep system, such chamber being designated generally by the numeral 10. The chamber 10 includes a base 12 surrounded by raised side chamber 14. The side chamber 14 and base 12 thus form a cavity 16. The cavity 16 is adapted to receive a floatation sleep system bladder, the perimeter of which is effectively supported by the side chamber 14 in the manner to be more fully explained hereinbelow.

Figure 3:
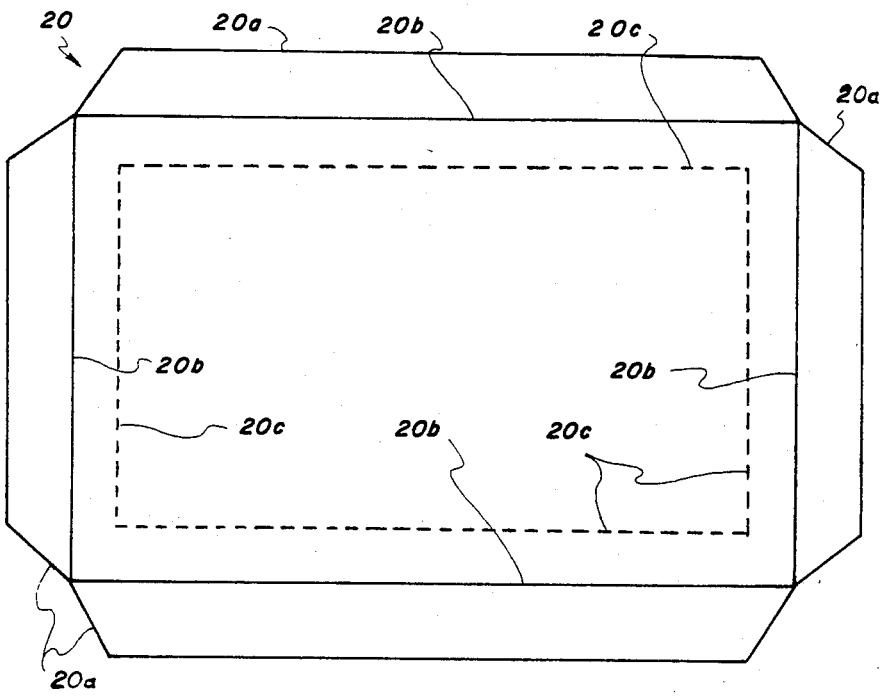
FIG. 3 is a top plan view of a sheet of flexible, dimensionally stable, material from which the containment chamber of FIG. 1 is formed.

The chamber 10 is formed of a flexible, dimensionally stable, sheet material, such as polyethylene or polypropylene for example. As best shown in FIG. 3 such sheet (designated by the numeral 20), when laid out in planar form, is of substantially rectangular dimensions, and has mitered portions **20*a* extending outwardly from the marginal edges 20*b* thereof. By a simplified assembly process, the portions 20*a* are folded back over the edges 20*b* onto the rectangular portion of the sheet 20 and joined thereto by heat sealing for example. The line upon which the joining of portions 20*a* to sheet 20 takes place is represented by the broken line 20*c*. The portions 20*a* are also joined, at adjacent edges, to one another thereby forming the raised side chamber 14**.

Such formed raised side chamber 14 accordingly have a sealed hollow interior **14*a*. The hollow interior 14*a* is adapted to contain a marginal perimeter support for a bladder received in the cavity 16 between the raised side chamber 14. For example, the hollow interior 14*a* may be pressurized with air admitted through a valve 22 (see FIG. 1) provided in the raised side chamber 14. Because the raised sides 14 are sealed to the base 12, the internal air pressure will cause such sides to assume and maintain the configuration shown in FIG. 4. Of course, other marginal perimeter supports, such a foam or liquid for example, located in the hollow interior 14*a*** are suitable for use with this invention.

Figure 5:
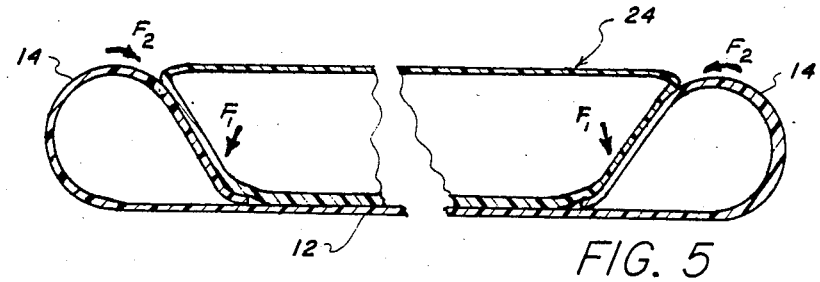
FIG. 5 is an end elevational view of the containment chamber similar to FIG. 4 particularly showing a bladder in such chamber and identifying the forces effective to maintain the marginal perimeter support in supporting relation with such bladder.

Referring back to the joining of portions **20*a* to sheet 20, the line 20*c* is located within the marginal edges 20*b* at a preselected distance therefrom so as to describe surface area which forms the base 12. Such surface area is substantially less than the corresponding surface area of the bladder to be received in the cavity 16. Accordingly, when a bladder (designated by numeral 24 in FIG. 5) is received in the cavity 16, a portion of its lower surface area will overlie a portion of the raised side chamber 14. The weight of the bladder 24 thus exerts a force $F_1$ on the portion of the raised side chamber on which the bladder lies. Since the material from which the raised side chamber is formed is dimensionally stable (i.e. does not stretch), a counteracting force $F_2$ is produced in the material. As is apparent in FIG. 5, the counteracting force $F_2$ urges the raised side chamber toward the marginal perimeter of the bladder 24. Therefore, the marginal perimeter support is effectively maintained in support relation to the marginal perimeter of the bladder 24**.

The invention has been described in detail with particular reference to the preferred embodiment thereof, but it will be understood that variations and modifications can be effected within the spirit and scope of the invention.

I claim:

1. A floatation sleep system including an improved marginal perimeter support containment chamber comprising:

a flexible, dimensionally stable, sheet having a surface area of substantially rectangular shape with portions extending outwardly from the marginal edges of said surface area, said portions being folded back and sealed to said surface area within the marginal edges thereof and to each other to form an open cavity adapted to receive a bladder and a closed chamber having a hollow substantially completely sealed interior adapted to receive a support mechanism for substantially the full perimeter of a bladder received within such cavity, the dimension of the area bounded by the joining of said portions to said surface area being less than the corresponding surface area of a bladder received within such cavity, whereby the bladder received within such cavity overlies a segment of said portions forming said chamber and the weight of such bladder acts on such segments to hold the support mechanism in said chamber in effective perimeter support relation with such bladder.

2. The invention of claim 1 wherein said portions include a valve communicating with the formed hollow interior of said chamber, whereby such chamber may be pressurized.

* * * * *